US006000153A

United States Patent [19]

Sollami

[11] Patent Number: 6,000,153

[45] Date of Patent: Dec. 14, 1999

[54] TOOTH ATTACHMENT FOR EARTH WORKING EQUIPMENT

[76] Inventor: Jimmie L. Sollami, P.O. Box 78, Carterville, Ill. 62918

[21] Appl. No.: 08/987,697

[22] Filed: Dec. 9, 1997

[51] Int. Cl.[6] ..... E02F 9/28

[52] U.S. Cl. ..... 37/453; 37/456; 37/465; 299/106

[58] Field of Search ..... 37/452, 464, 465, 37/462, 453, 456; 299/106, 107, FOR 91

[56] References Cited

U.S. PATENT DOCUMENTS 3,841,708 10/1974 Kniff et al. .
4,247,150 1/1981 Wrulich et al. .
4,316,636 2/1982 Taylor et al. .
4,711,504 12/1987 Berchem .
4,712,321 12/1987 Berchem et al. .
4,736,533 4/1988 May et al. .
4,911,504 3/1990 Stiffler et al. .
5,067,775 11/1991 D'Angelo .
5,230,548 7/1993 Southern .
5,273,343 12/1993 Ojanen .
5,417,475 5/1995 Graham et al. .

*Primary Examiner*—H. Shackelford
*Attorney, Agent, or Firm*—Pitts & Brittian, P.C.

[57] ABSTRACT

A tooth attachment for earth working equipment which is configured to receive a conventional cutter bit. The tooth attachment includes a body which defines an upper end and a lower end. The upper end defines a bit holder configured to receive a conventional cutter bit and the lower end is configured to be releasably securable to the post of an implement of earth working equipment such as dragline equipment, a backhoe, a bulldozer, a grader or the like.

2 Claims, 3 Drawing Sheets

TOOTH ATTACHMENT FOR EARTH WORKING EQUIPMENT

TECHNICAL FIELD

This invention relates to the field of earth working equipment and specifically to a tooth which is configured to permit replacement of the earth engaging tip.

BACKGROUND ART

Drag line teeth are attached to the buckets of bulldozers, draglines and equipment of the like. Dragline teeth are manufactured from steel and are configured for use in removing rock and material of the like from an excavation site. A conventional dragline tooth defines a conical configuration and a means for removably attaching it to a post carried on an implement of earth working equipment such as dragline equipment, a backhoe, a bulldozer, a grader or the like. After repeated use, the tip of the tooth wears away and the tooth must be replaced. When moving particularly hard earth or rocks the number of tooth replacements can be excessive.

In the field of rotary mining and construction tools, replaceable bits with carbide tips are utilized. Typically, a bit holder is welded to the mining or construction equipment and is configured to retain a bit therein. When the tip of the bit is worn down, the bit is removed from the bit holder and replaced with a new bit. Typical of the art are those devices disclosed in the following U.S. Patents:

| U.S. Pat. No. | Inventor(s) | Issue Date |
|---|---|---|
| 4,247,150 | Wrulich et al. | January 27, 1981 |
| 4,911,504 | Stiffler et al. | May 27, 1990 |
| 5,067,775 | M. D. D'Angelo | November 26, 1991 |
| 5,230,548 | P. W. Southern | July 27, 1993 |
| 5,273,343 | R. W. Ojanen | December 28, 1993 |
| 5,417,475 | Graham et al. | May 23, 1995 |

It is an object of this invention to provide a tooth attachment specifically designed to extend the life of teeth attached to an implement of earth working equipment.

Further, it is an object of the present invention to provide a tooth attachment which is configured to receive a conventional cutter bit.

It is another object of the present invention to provide a modified tooth attachment which is remanufactured from an existing worn tooth attachment.

SUMMARY

Other objects and advantages will be accomplished by the present invention which teaches a tooth attachment for earth working equipment which is configured to receive conventional cutter bits. The tooth attachment of the present invention includes a body which defines an upper end and a lower end. The upper end defines a bit holder configured to receive a conventional cutter bit and the lower end is configured to be releasably securable to the post of an implement of earth working equipment such as the bucket of a backhoe, a bull dozer, a grader, dragline equipment or the like.

BRIEF DESCRIPTION OF THE DRAWINGS

The above mentioned features of the invention will become more clearly understood from the following detailed description of the invention read together with the drawings in which.

DESCRIPTION OF PREFERRED EMBODIMENTS

A tooth attachment for earth working equipment incorporating various features of the present invention is illustrated generally at 10 in the figures. The tooth attachment 10 is designed specifically to extend the life of tooth attachments for the implements of earthworking equipment such as dragline equipment, a bulldozer, a backhoe, a grader or the like. Moreover, in the preferred embodiment, the tooth attachment 10 is designed to receive typical cutter bits. Further, the tooth attachment can be formed from worn prior art teeth or may be newly cast.

Figure 1:
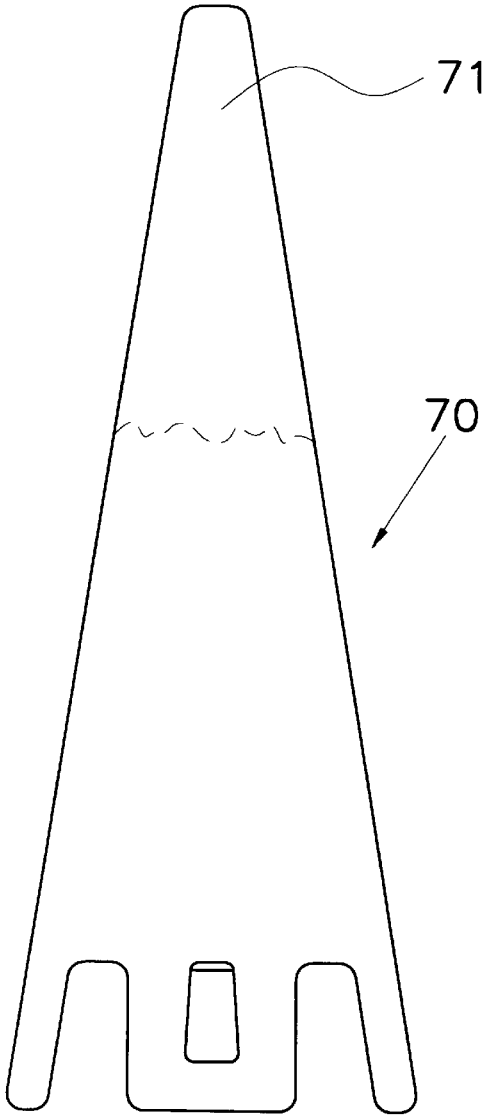
Fig.1 (PRIOR ART)
FIG. 1 is a side view of a prior art dragline tooth illustrating its initial configuration and its worn down configuration.

As stated previously, a conventional dragline tooth 70 defines a conical configuration and a means for removably securing it to a post of a bucket or other implement of earth working equipment, as shown in FIG. 1. After repeated use, the tip 71 of the dragline tooth 70 wears away and the tooth must be replaced. A typically worn tooth is illustrated in phantom in FIG. 1.

Figure 2:
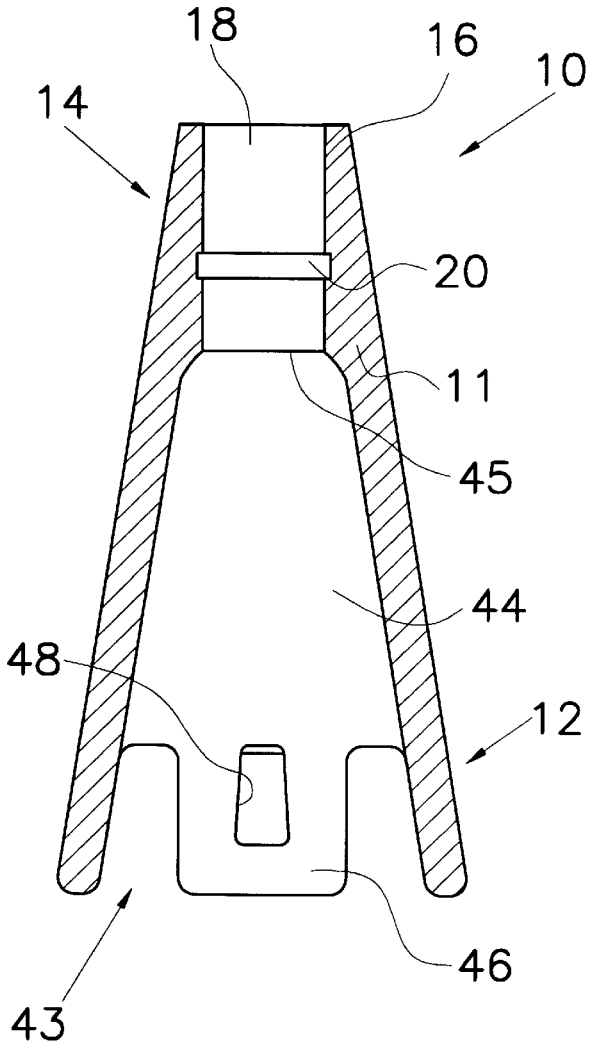
FIG. 2 is a side view, in section, of the tooth attachment of the present invention.

The tooth attachment 10 of the present invention is designed to replace the conventional dragline tooth 70. As shown in FIG. 2, the lower end 12 of the body 11 of the tooth attachment 10 is configured to mount to a post in the same manner as the prior art tooth. A bit holder 16 is defined at the upper end 14 of the body 11 and is specifically configured to receive the shank 24 of a conventional cutter bit 22 typically utilized in conjunction with mining and construction tools.

Figure 3B:
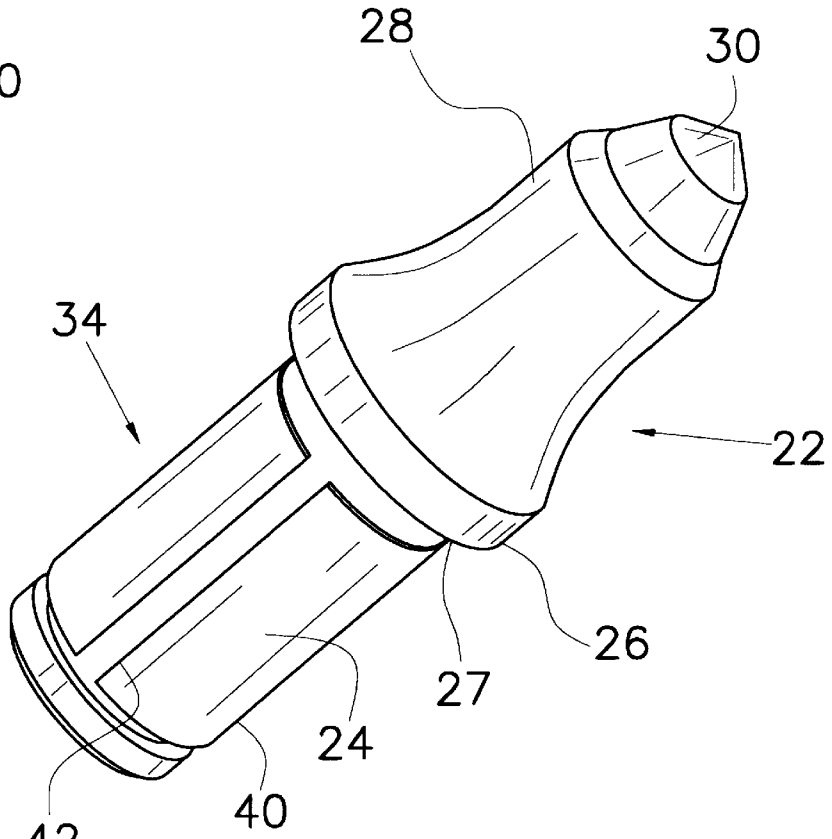
FIG. 3B illustrates a conventional cutter bit with a sleeve holding mechanism.
Figure 3A:
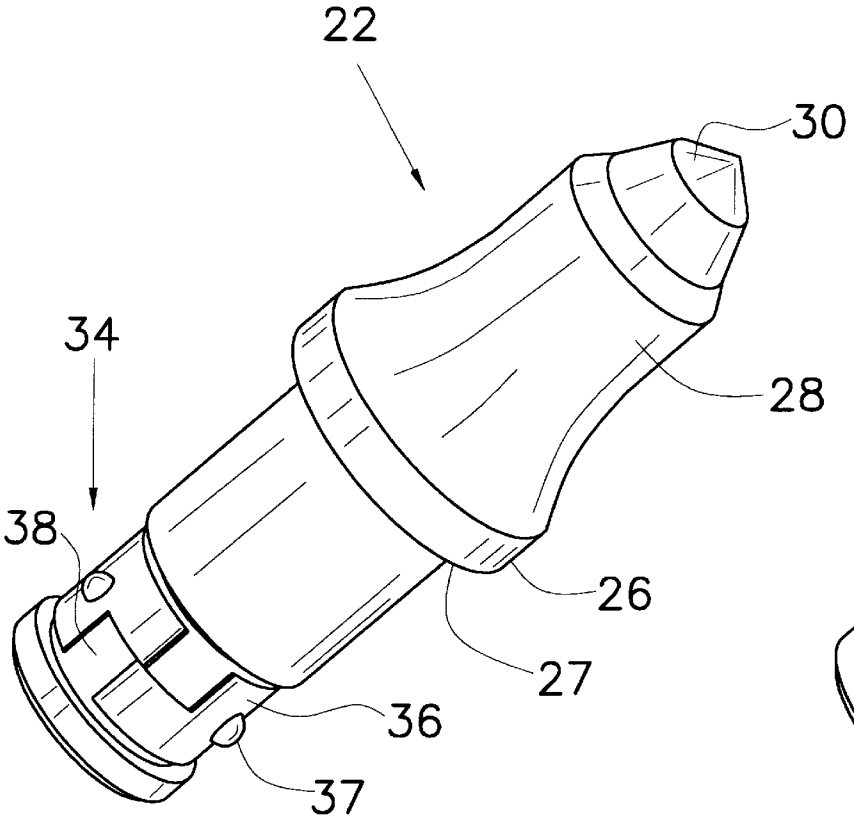
FIG. 3A illustrates a conventional cutter bit with a band holding mechanism.

A conventional cutter bit 22, illustrated in FIGS. 3A and 3B, includes a shank 24, a flange 26, an upper body 28 and a cutting insert 30. The shank 24 is configured to be retained in a holder 16. The flange 26 provides an abutment face 27 for limiting the insertion of the bit 22 in the holder 16. Further, the flange 26 protects the holder 16 by preventing fines from entering the holder 16 thereby reducing abrasion. Further, the flange 26 acts as a bearing surface between the bit 22 and the holder 16 (thrust bearing) thereby protecting the shank and the face of the holder. Moreover, the flange 26 is configured to improve the rotation of the tool such that the life of the tool is increased. The cutting insert 30 is embedded in the upper body 28 and is typically manufactured from carbide or diamond.

The shank 24 includes a holding mechanism 34 for being retained in the holder. Typical holding mechanisms 34 are a band 36, shown in FIG. 3A, a sleeve 40, shown in FIG. 3B, and a ring (not shown). These holding mechanisms 34 support the shank 24 in a rotatable manner such that the bit 22 is self-sharpening. The band 36 includes a plurality of nodules 37 which extend outward from its surface and a cutout portion 38 for contraction of the band 36. The cutout portion 38 is configured to prevent axial movement during insertion in a holder but permits contraction circumferentially to insert the band 36 in a holder. The nodules 37 retain the band 36 in a radial slot defined by the holder.

The sleeve 40 surrounds most of the shank 24, defines a cutout portion 42 for contraction of the sleeve, as shown in FIG. 3B, and provides a frictional fit in the holder.

Although not shown, the holding mechanism can also include a rib encircling the band 36 or the sleeve 40 which is retained in the radial slot defined by the holder.

The ring is mounted on a reduced diameter rear portion of the shank to retain the tool in a holder or bore. In the present invention, the ring holding mechanism is not utilized.

The tooth attachment 10 illustrated in FIG. 2 defines a body 11 with a truncated conical configuration and, as stated above, defines a bit holder 16 at the upper end 14 and a means for mounting 43 at the lower end 12. Specifically, the lower end 12 of the tooth attachment defines a post receptor cavity 44 and a plurality of extensions 46. Two oppositely disposed extensions 46 define pin receiving openings 48. The post receptor cavity 44 is configured to securely receive the post 72 of an implement of earth working equipment such as a bulldozer, a backhoe etc. The pin receiving openings 48 align with an opening (not shown) defined through the post and receive a pin (not shown) therethrough to secure the tooth attachment 10 to the post 72.

Figure 4:
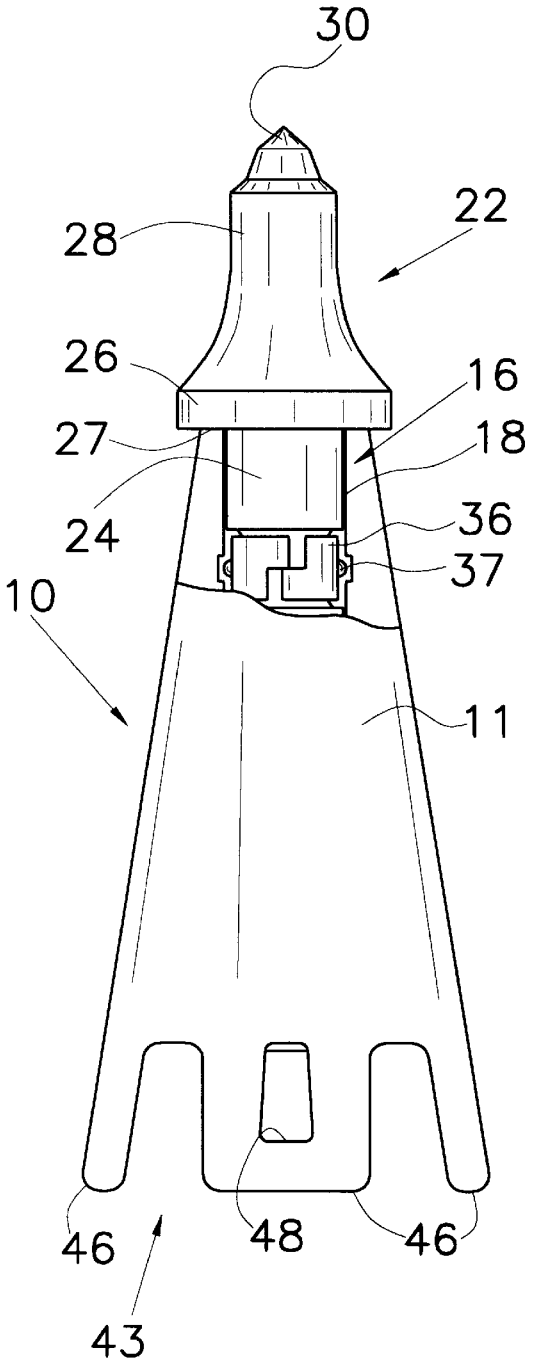
FIG. 4 illustrates a cutter bit with a band holding mechanism inserted in the bit holder of the tooth attachment.
Figure 5:
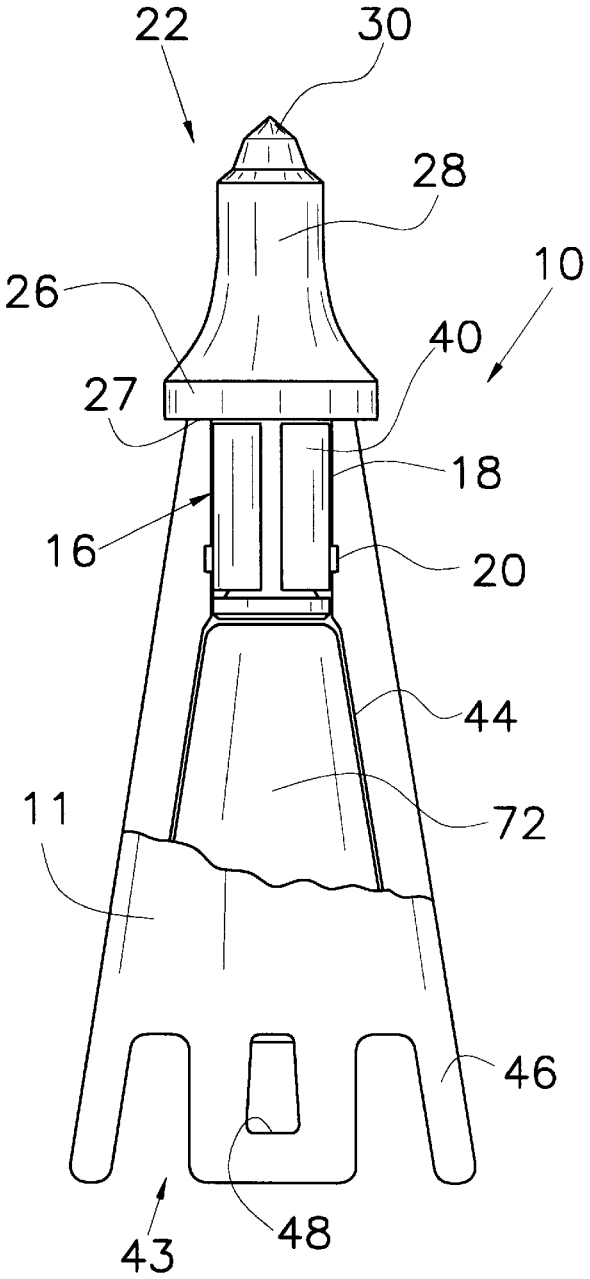
FIG. 5 illustrates a cutter bit with a sleeve holding mechanism inserted in the bit holder of the tooth attachment.

The bit holder 16 is configured such that it can receive and retain cutter bits 22 with a band holding mechanism 36, as well as cutter bits with a sleeve holding mechanism 40. Specifically, the bit holder 16 defines a cylindrical opening 18 which extends to the upper end 45 of the post receptor cavity 44, as shown in FIG. 2. The cylindrical opening 18 defines a circumferential slot 20 and defines a length which receives the length of the shank 24 of the bit 22 such that the shank 24 does not extend into the post receptor cavity 44. The cylindrical opening 18 is configured to receive and support a cutter bit 22 with a sleeve holding mechanism 40, as shown in FIG. 5. The cylindrical opening 18 in conjunction with circumferential slot 20 supports a cutter bit 22 with a band holding mechanism 36, as shown in FIG. 4. It will be noted that the circumferential slot 20 is not limited to the disposition depicted, its location is dependent upon the configuration of the cutter bits to be supported in the bit holder.

The tooth attachment 10 can be produced using one of two methods. In the first method, a worn tooth or previously formed prior art tooth is modified. Specifically, the tip 71 of a tooth 70 is cut off such that the remainder of the body 11 defines a desired length. It will be noted that the length of the body 11 is dependent upon the length of the shank 24 to received in the bit holder 16. The cylindrical opening 18 is drilled or bored out of the upper end of the tooth through to the post receptor cavity thereby forming a bit holder for a bit with a sleeve holding mechanism 40 mounted to its shank. A circumferential slot 20 is bored out of the cylindrical opening 18 thereby forming a bit holder 16 for a bit with a band holding mechanism 36 mounted to its shank.

Further, the tooth attachment 10 of the present invention can be formed by casting. It will be noted that the tooth attachment is fabricated from steel.

From the foregoing description, it will be recognized by those skilled in the art that a tooth attachment for earth working equipment offering advantages over the prior art has been provided. Specifically, the tooth attachment is designed to extend the life of teeth attached to the implements of earth working equipment such as dragline equipment, a backhoe, a bulldozer and earth working equipment of the like. Further, the tooth attachment is configured to receive a conventional cutter bit and the tooth attachment can be formed from existing worn teeth.

While a preferred embodiment has been shown and described, it will be understood that it is not intended to limit the disclosure, but rather it is intended to cover all modifications and alternate methods falling within the spirit and the scope of the invention as defined in the appended claims.

Having thus described the aforementioned invention, I claim:

1. A method for modifying a conventional tooth to which is releasably securable to a post carried on an implement of earth working equipment to produce a tooth attachment which is configured to receive a conventional cutter bit therein, the conventional cutter bit defining a shank with a holding mechanism mounted thereto, said method comprising the steps of:

removing a tip of the conventional tooth to produce a body of a desired length, said body defining an upper end and a lower end; and boring a cylindrical opening in said upper end of said body, said cylindrical opening being configured to receive a shank of a conventional cutter bit, the conventional cutter bit being retained in said cylindrical opening via a first holding mechanism mounted to the shank, the first holding mechanism being configured to permit the bit to rotate freely.

2. The method of claim 1 further including the step of boring a circumferential slot in said cylindrical opening, said cylindrical opening and said circumferential slot being configured to receive a shank of a conventional cutter bit, the conventional cutter bit being retained in said cylindrical opening via a second holding mechanism mounted to the shank, the second holding mechanism being configured to permit the bit to rotate freely.

* * * * *